US009159305B1

(12) United States Patent
Mazzarisi

(10) Patent No.: US 9,159,305 B1
(45) Date of Patent: Oct. 13, 2015

(54) PITCH AND TONE ALTERING DRUM COVER

(71) Applicant: Kris Adam Mazzarisi, Seaford, NY (US)

(72) Inventor: Kris Adam Mazzarisi, Seaford, NY (US)

( * ) Notice: Subject to any disclaimer, the term of this patent is extended or adjusted under 35 U.S.C. 154(b) by 1 day.

(21) Appl. No.: 14/251,103

(22) Filed: Apr. 11, 2014

(51) Int. Cl.
*G10D 13/02* (2006.01)

(52) U.S. Cl.
CPC ..... *G10D 13/021* (2013.01); *G10D 13/027* (2013.01)

(58) Field of Classification Search
CPC ..... G10D 13/022; G10D 13/027
See application file for complete search history.

(56) References Cited

U.S. PATENT DOCUMENTS

| | | | | | |
|---|---|---|---|---|---|
| 3,453,924 | A * | 7/1969 | Glick et al. | 84/411 R |
| 4,244,266 | A * | 1/1981 | Hardy | 84/411 M |
| 4,254,685 | A * | 3/1981 | Rose | 84/414 |
| 4,798,121 | A * | 1/1989 | Donohoe | 84/414 |
| 5,159,139 | A * | 10/1992 | Beals et al. | 84/414 |
| 5,493,942 | A * | 2/1996 | Wolf | 84/411 R |
| 5,920,021 | A * | 7/1999 | Good | 84/411 M |
| 5,998,716 | A * | 12/1999 | Marquez et al. | 84/411 P |
| 6,518,490 | B2 * | 2/2003 | Good | 84/414 |
| 6,580,023 | B2 * | 6/2003 | Belli | 84/411 R |
| 6,686,526 | B2 * | 2/2004 | Ezbicki | 84/411 R |
| 6,759,582 | B2 * | 7/2004 | Rouston | 84/421 |
| 7,214,867 | B1 * | 5/2007 | Gatzen et al. | 84/411 R |
| 7,476,794 | B2 * | 1/2009 | May, Jr. | 84/411 R |
| 7,932,452 | B2 * | 4/2011 | Chen | 84/411 R |
| 8,148,619 | B1 * | 4/2012 | May et al. | 84/411 M |
| 8,759,652 | B2 * | 6/2014 | Caprarola | 84/411 M |
| 8,766,073 | B2 * | 7/2014 | Eckermann | 84/411 R |
| 8,916,759 | B2 * | 12/2014 | Hashimoto | 84/411 R |
| 8,962,962 | B2 * | 2/2015 | Jones | 84/411 R |
| 2013/0312585 | A1 * | 11/2013 | Yunbin et al. | 84/414 |
| 2014/0069256 | A1 * | 3/2014 | Hashimoto | 84/414 |
| 2014/0144309 | A1 * | 5/2014 | Cawthorne | 84/411 R |
| 2015/0000503 | A1 * | 1/2015 | Fitzgerald | 84/411 R |
| 2015/0122107 | A1 * | 5/2015 | deLoache et al. | 84/411 R |

* cited by examiner

*Primary Examiner* — Robert W Horn

(57) ABSTRACT

A pitch altering cover for a drumhead is provided. The pitch altering cover includes a circular drumhead cover having an upper surface and a lower surface. The lower surface is formed to rest on a drumhead. A gasket is attached at least a portion of a parameter of the upper surface of the circular drumhead cover.

10 Claims, 2 Drawing Sheets

FIG.1
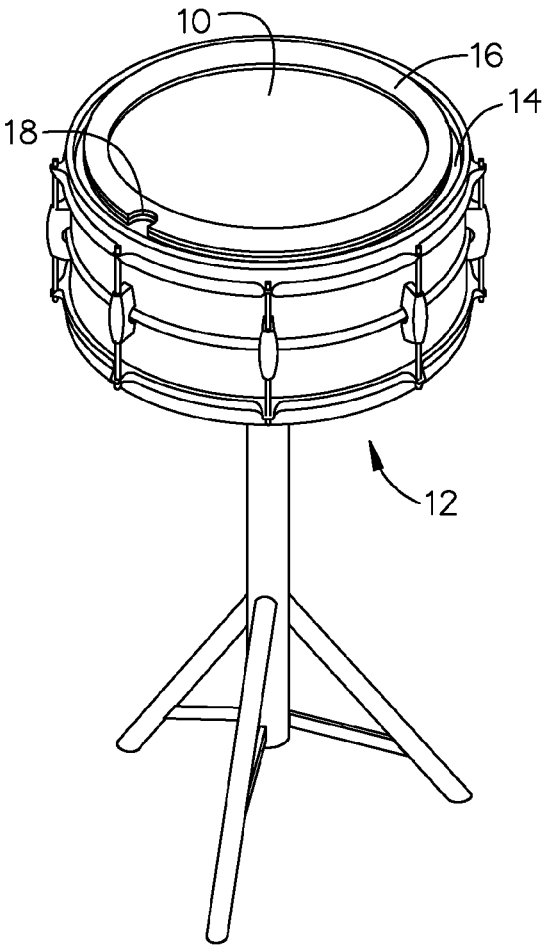
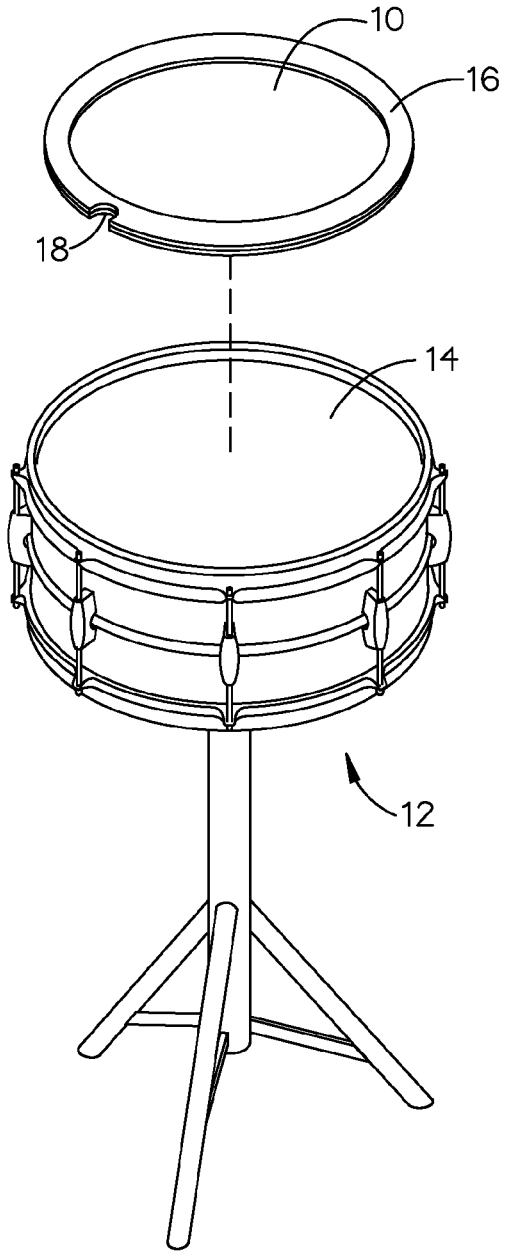
FIG.2

PITCH AND TONE ALTERING DRUM COVER

BACKGROUND OF THE INVENTION

The present invention relates to a pitch altering cover and, more particularly, to a drumhead cover that alters the pitch of the drum.

The drum is a member of the percussion group of musical instruments. Drums consist of at least one membrane, called a drumhead or drum skin that is stretched over a shell and struck, either directly with the players hands, or with a drum stick, to produce sound. When recording or playing a live show, drummers sometimes want a deeper sound from a drum but do not want to carry a second drum or retune the drum for just one song.

As can be seen, there is a need for a device that quickly changes the pitch of a drum.

SUMMARY OF THE INVENTION

In one aspect of the present invention, a pitch altering cover comprises: a drumhead cover comprising an upper surface and a lower surface, wherein the lower surface is formed to rest on a drumhead; a gasket attached at least a portion of a perimeter of the upper surface of the circular drumhead cover.

In another aspect of the present invention, a method of altering the pitch of a drum comprises: placing a circular drum-head cover over a drum-head, wherein the drumhead cover comprises a rubber gasket attached to the perimeter of the circular drumhead cover; and striking the drum with the drumhead cover covering the surface of the drumhead.

These and other features, aspects and advantages of the present invention will become better understood with reference to the following drawings, description and claims.

BRIEF DESCRIPTION OF THE DRAWINGS

FIG. 1 is a perspective view of the present invention shown on an exemplary drum;

FIG. 2 is an exploded view of the present invention;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a drumhead cover/topper which lowers the fundamental pitch, tone and tuning of a drum. The present invention creates a surface layer between the drum sticks and the drum's head layer. This allows for the fundamental pitch of the drum to be lowered and change the pitch, resonance, sustain, overtones, timbre and sound of the drum. The present invention also cuts the high end frequency from the drum. The drumhead topper works on a beginner to professional level snare drum creating the big fat snare drum sound.

Figure 3:
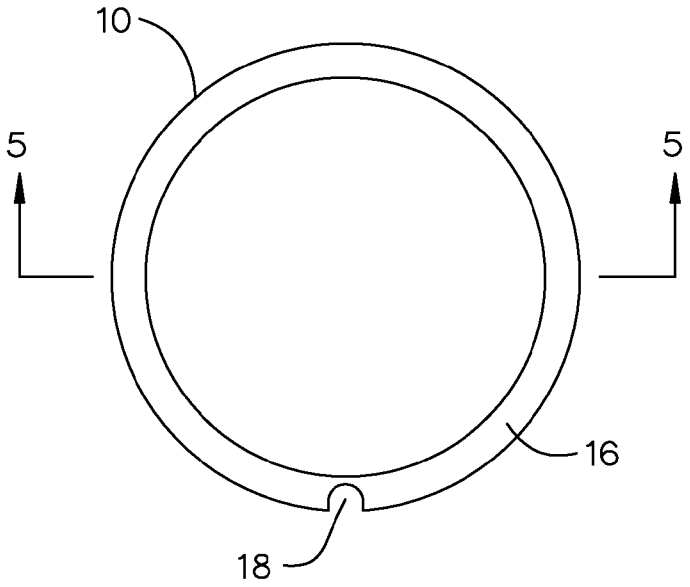
FIG. 3 is a top view of the present invention.
Figure 4:
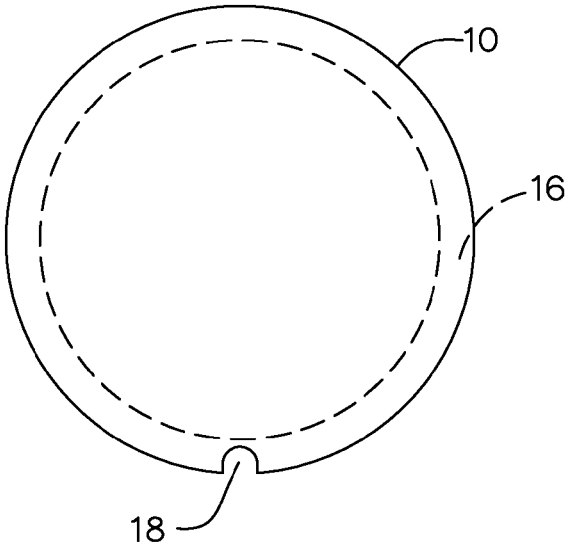
FIG. 4 is a bottom view of the present invention.
Figure 5:
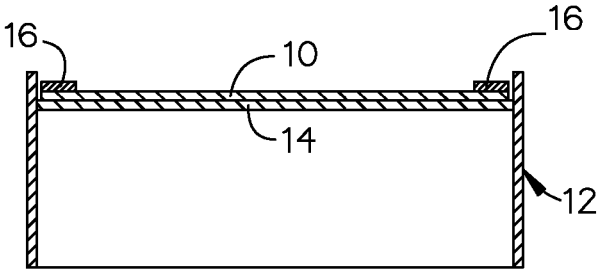
FIG. 5 is a section view of the present invention taken along line 5-5 of FIG. 3

Referring to FIGS. 1 through 5, the present invention includes a pitch altering cover. The pitch altering cover includes a circular drumhead cover 10 having an upper surface and a lower surface. The lower surface is formed to rest on a drumhead 14. A gasket 16 is attached at least a portion of a perimeter of the upper surface of the circular drumhead cover 10.

In certain embodiments, the drumhead cover 10 may be a thin circular piece of plastic. For example, the drumhead cover 10 may be made of Mylar® polyester plastic film. The drumhead cover 10 may lower the pitch of drum 12. In certain embodiments, the drumhead cover 10 may have a 13.75 inch diameter to fit within a 14 inch round drum 12. However, the size of the drumhead cover 10 may be altered to accommodate different sized drums 12.

In certain embodiments, the gasket 16 of the present invention may include a rubber gasket 16. The rubber gasket 16 may be made of a neoprene rubber. The rubber gasket 16 may contribute to lowering the fundamental pitch of the drum 12 as well as adding weight to the drumhead cover 10 to keep the drumhead cover 10 properly seated on top of the drumhead 14. The gasket may give the drumhead cover 10 a perfect amount of flex to maintain the shape while taking the abuse of a striking drum stick.

The gasket 16 may be attached to the drumhead cover 10 by a fastener. The fastener may include an adhesive, such as a glue. The glue may be a 3M® 9471 adhesive. The rubber gasket 16 may be attached to the drumhead cover 10 around at least a portion of the perimeter. For example, the gasket 16 may be attached to the drumhead cover 10 circumferentially. In certain embodiments, a thumb opening or notch 18 may be cut out of the gasket 16 and the drumhead cover 10. The notch 18 may allow a user to easily grasp and remove the drumhead cover 10 from the drumhead 14.

A method of making the present invention may include the following. First, die cut flat plastic to about 13.75 inch. The plastic may be Mylar® A frosted Polyester Film blend about 0.010 mil thick. Then, die cut (2×) crescent shaped half circles of neoprene rubber (durometer of 50) forming the 13.75 inch outer ring. Glue the gasket and the head cover together with 3M 9471 adhesive. Then, die cut the thumb cut out hole about 1 inch in length and about 0.75 inches in width into the Mylar® polyester plastic and the neoprene rubber gasket.

By placing the appropriately sized finished product on top of a chosen tuned drum, the weight of the materials and the plies of the product unite to successfully change the pitch, resonance, sustain, overtones, timbre and tuning of the chosen drum. When placed over the existing drumhead, the added combination of weight and material provides the deeper desired sound immediately. The plastic head topper may lower the fundamental pitch of the drum. The rubber gasket gives the drumhead topper form, structure and the needed weight to improve the sound, sturdiness and keep it properly seated on top of the drum. The thumb cutout allows for quick removal of the drum topper from the drum.

In alternative embodiments, the gasket may be formed of different materials, such as but not limited to, cork, plastic, metal, felt foam, or any polymer. The present invention may include tambourine jingles, rivets, shakers, sizzle chains, and the like. The present invention may be used for any sized drumhead.

It should be understood, of course, that the foregoing relates to exemplary embodiments of the invention and that modifications may be made without departing from the spirit and scope of the invention as set forth in the following claims.

What is claimed is:

1. A pitch and tone altering cover comprising:

a drumhead cover comprising an upper surface and a lower surface, wherein the lower surface is formed to rest on a drumhead;

a gasket attached to at least a portion of a perimeter of the upper surface of the circular drumhead cover.

2. A pitch and tone altering cover of claim 1, wherein the drumhead cover is circular.

3. A pitch and tone altering cover of claim 2, wherein the gasket is a ring shaped gasket circumferentially attached to the circular drumhead cover.

4. A pitch and tone altering cover of claim 1, wherein the gasket is a rubber gasket.

5. A pitch and tone altering cover of claim 1, wherein the drumhead cover is polyester.

6. A pitch and tone altering cover of claim 1, wherein the gasket is attached to the drumhead cover by a glue.

7. A pitch and tone altering cover of claim 1, further comprising a notch through the drumhead cover and the gasket.

8. A method of altering the pitch and tone of a drumhead comprising:

placing a circular drumhead cover over a drumhead, wherein the drumhead cover comprises a rubber gasket attached to the perimeter of the circular drum head cover; and striking the drum with the drumhead cover covering the surface of the drumhead.

9. The method of claim 7, wherein the circular drumhead cover is polyester.

10. The method of claim 7, further comprising a notch through the drumhead cover and the gasket.

* * * * *